US006810999B2

(12) United States Patent
Otter

(10) Patent No.: US 6,810,999 B2
(45) Date of Patent: Nov. 2, 2004

(54) REDUCTION OF OIL ENTRAPMENT IN HEAT EXCHANGER TUBING

(75) Inventor: James William Otter, Fairfield Glade, TN (US)

(73) Assignee: Carrier Corporation, Syracuse, NY (US)

( * ) Notice: Subject to any disclaimer, the term of this patent is extended or adjusted under 35 U.S.C. 154(b) by 296 days.

(21) Appl. No.: 09/923,998

(22) Filed: Aug. 7, 2001

(65) Prior Publication Data

US 2003/0029678 A1 Feb. 13, 2003

(51) Int. Cl.[7] ..... F01M 5/00

(52) U.S. Cl. ..... 184/104.1; 165/133; 165/905; 428/36.92

(58) Field of Search ..... 184/6.22, 104.1; 165/133, 134.1, 135, 905; 428/36.91, 36.92, 35.8

(56) References Cited

U.S. PATENT DOCUMENTS 3,925,149 A * 12/1975 Erwin ..... 165/133
4,644,907 A * 2/1987 Hunter ..... 165/133
4,895,881 A * 1/1990 Bigner ..... 523/122
5,033,272 A * 7/1991 Yoshikawa et al. ..... 165/133
5,078,946 A * 1/1992 Fletcher et al. ..... 264/292
5,992,508 A * 11/1999 Lowenstein et al. ..... 165/46
6,044,660 A * 4/2000 Numoto et al. ..... 62/468
6,467,303 B2 * 10/2002 Ross ..... 62/509

FOREIGN PATENT DOCUMENTS

EP 864622 A2 * 9/1998 ..... C09D/183/08

* cited by examiner

*Primary Examiner*—Chong H. Kim
(74) *Attorney, Agent, or Firm*—Carlson, Gaskey & Olds

(57) ABSTRACT

A thin coating of a solution containing a low surface energy material is applied on the inner surface of tubing of a condenser or an evaporator of an air conditioning system. The solution is run through the tubing of the heat exchanger and drained. After drying, a monomolecular layer of the low surface energy material in solution remains on the inner surface of the tubing. A polymer with a lower surface energy and chemical and thermal resistance is employed, such as silane, fluorocarbons, polyetheretherketon (PEEK) and polysulfone. The thin coating of the lower surface energy material in solution prevents lubricating oil from the compressor which mixes with the refrigerant from wetting over the inner surface of the tubing, encouraging the formation of oil droplets. By preventing the build up of lubricating oil, heat transfer is improved.

18 Claims, 2 Drawing Sheets

REDUCTION OF OIL ENTRAPMENT IN HEAT EXCHANGER TUBING

BACKGROUND OF THE INVENTION

The present invention relates generally to a method for reducing the entrapment of lubricating oil in the tubing of an air conditioner heat exchanger by coating the tubing with a low surface energy coating, improving the heat transfer in evaporators and condensers.

During operation of an air conditioner or other refrigerant cycle, lubricating oil in the compressor may leak and mix with the refrigerant that circulates through the air conditioning system. As the refrigerant flows through the tubing of the evaporating and condensing heat exchangers, the lubricating oil coats and wets the inner surface of the heat exchangers.

Often, the inner surface of the tubing of a heat exchanger is provided with interstices to increase the effective area for heat transfer. As the refrigerant flows through the evaporator, the lubricating oil mixed with the refrigerant is easily entrapped in the interstices of the tubing, smoothing the inner surface and reducing the effective area for heat transfer. Additionally, the tubing of the evaporating heat exchanger is commonly made of copper or aluminum which easily oxidizes to form an oxide layer having a high surface energy. As the oxide layer has a high surface energy, the oxide layer wets well, further causing the lubricating oil to adhere as a film on the inner surface of the evaporator. Additionally, if the condenser is enhanced, the layer of lubricating oil is further encouraged by entrapment in the textured surface formed by the interstices. To improve heat transfer, it is preferred that the lubricating oil form droplets rather than a film on the inner surface of the heat exchangers of an air conditioner.

Hence, there is a need in the art for a method for reducing oil entrapment on the inner surface of the tubing of a heat exchanger of an air conditioner.

SUMMARY OF THE INVENTION

The present invention relates to a method for reducing oil entrapment on the inner surface of the tubing of a heat exchanger of an air conditioner.

A thin coating of a lower surface energy material in solution is applied on the inner surface a condenser or an evaporator. The solution is applied by running the solution through the tubing of the heat exchanger. After the solution is drained from the tubing and the inner surface of the heat exchanger is dried, a monomolecular layer of the material in solution remains on the inner surface of the heat exchanger.

Any polymer with a lower surface energy and having a chemical and thermal resistance can be employed in the solution. Preferably, silane, fluorocarbons, polyetheretherketon (PEEK) and polysulfones are utilized in the solution as these polymers have lower surface energies and will coat and adhere to the inner surface of the tubing. Most preferably, silane is employed in low concentrations of 1–2% by weight as the polymer in the lower surface energy solution.

By applying a thin coating of a lower surface energy material to the inner surface of either an evaporating or condensing heat exchanger, lubricating oil in the compressor which mixes with the refrigerant circulating through the air conditioning system will not wet and form a film over the higher surface energy oxide coated inner surface of the heat exchanger. As the thin coating of the lower surface energy material on the inner surface of the heat exchanger has a lower surface energy, droplets of lubricating oil will form. By preventing the wetting of lubricating oil on the inner surface of the evaporator, heat transfer is improved.

Accordingly, the present invention provides a method for reducing oil entrapment on the inner surface of the tubing of a heat exchanger of an air conditioner.

These and other features of the present invention will be best understood from the following specification and drawings.

BRIEF DESCRIPTION OF THE DRAWINGS

The various features and advantages of the invention will become apparent to those skilled in the art from the following detailed description of the currently preferred embodiment. The drawings that accompany the detailed description can be briefly described as follows.

DETAILED DESCRIPTION OF THE PREFERRED EMBODIMENT

Figure 1:
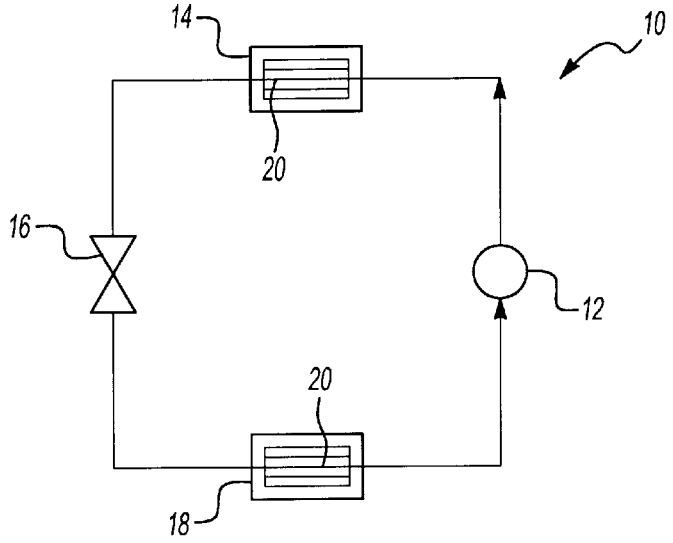
FIG. 1 illustrates a schematic diagram of a prior art air conditioning cycle.

FIG. 1 illustrates a schematic diagram of a prior art air conditioning system 10 or other refrigerant. The system 10 includes a compressor 12, a heat rejecting heat exchanger (condenser) 14, an expansion device 16, and a heat accepting heat exchanger (evaporator) 18. Refrigerant circulates though the closed circuit system 10. After the refrigerant exits the compressor 12 at high pressure and enthalpy, the refrigerant flows through the condenser 14 and loses heat, exiting the condenser 14 at low enthalpy and high pressure. As the refrigerant passes through the expansion device 16, the pressure drops. After expansion, the refrigerant flows through the evaporator 18 and exits at a high enthalpy and low pressure. The refrigerant re-enters and passes through the compressor 12, completely flowing through the system 10.

Figure 2A:
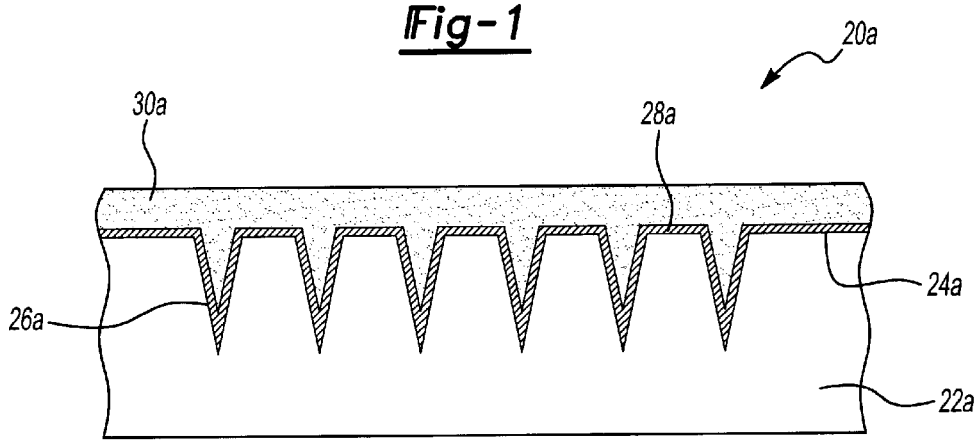
Fig-2A PRIOR ART
FIG. 2A illustrates a cross-sectional view of a section of an evaporator of the prior art.

The evaporator 18 and the condenser 14 include a plurality of tubes 20, shown schematically in FIG. 1, and which form a plurality of flow passages through which refrigerant 36 flows. As known, the refrigerant 36 accepts heat from a fluid 38 that flows around the plurality of tubes 20 in the evaporator 18. FIG. 2A illustrates a section of a prior art tube 20A of an evaporator 18. The tube 20A is formed of a metal body 22A including an inner surface 24A and is preferably made of copper or aluminum. A plurality of interstices 26A are formed in the inner surface 24A of the tubing 20A to increase the surface area of heat transfer. Because copper and aluminum oxide easily, a thin high surface energy oxide layer 28A forms on the metal inner surface 24A. As the refrigerant flows though the tubes 20A, lubricating oil from the compressor 12 which mixes with the refrigerant forms a layer or lubricating oil 30A on the high surface energy oxide layer 28A, reducing the effective heat transfer area. For illustrative purposes, the layers 28A and 30A are shown enlarged and not to scale.

Figure 2B:
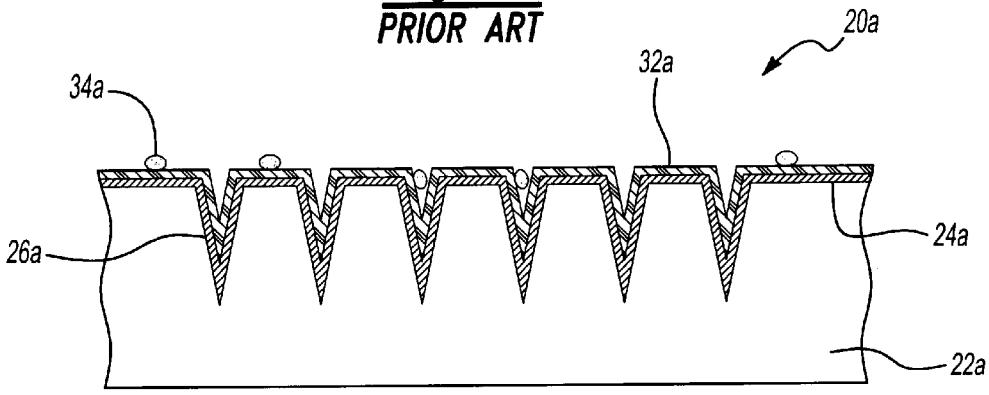
FIG. 2B illustrates a cross-sectional view of a section of an evaporator with the lower surface energy thin coating of the present invention.

As shown in FIG. 2B, the method of the present invention provides a thin coating 32A of a lower surface energy material on the inner surface 24A of the tubing 20A of an evaporator 18. After making the lower surface energy solution, the solution is flowed through the tubing 20A. The solution is drained, and the tubing 20A is dried, forming a thin monomolecular coating 32A of the low surface energy material that was in solution on the inner surface 24A of the tubing 20A. By applying a thin coating 32A of a lower surface energy material to the inner surface 24A of the tubing 20A, lubricating oil from the compressor 12 which mixes with the refrigerant will form droplets 34A rather than a film on the tubing 20A. As the interstices 26A are not coated, heat transfer can be maximized.

Figure 3A:
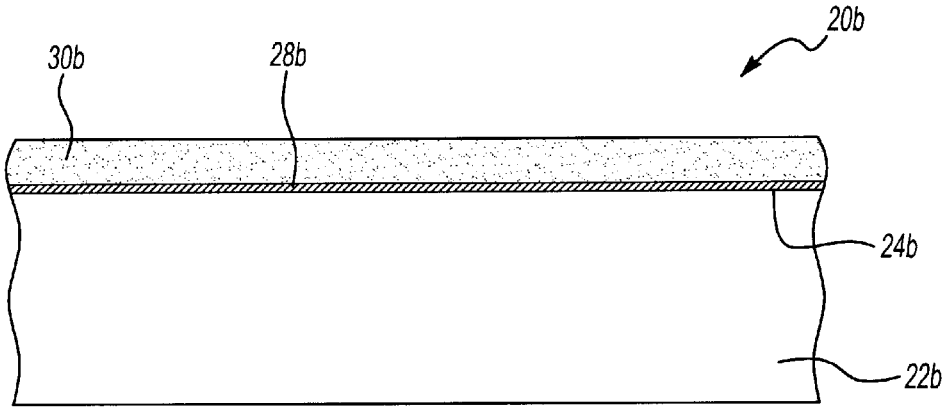
Fig-3A PRIOR ART
FIG. 3A illustrates a cross-sectional view of a section of a condenser of the prior art.

FIG. 3A illustrates a prior art tube 20B of a condenser 14. The inner surface 24B of the metal body 22B of the condenser 14 does not include interstices. However, interstices can be formed on the inner surface 24B if desired. As with the evaporator 18, a high surface energy oxide layer 28B is formed on the inner surface 24B, promoting the wetting of a layer of lubrication oil 30B, which reduces the amount of heat transfer.

Figure 3B:
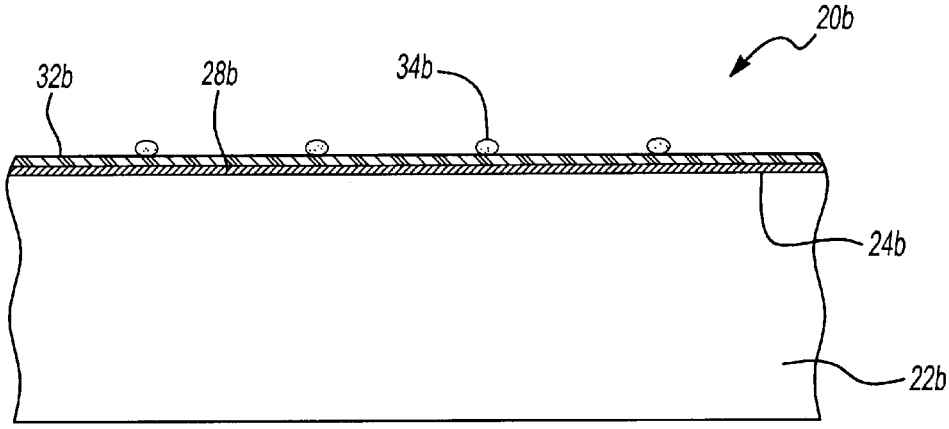
FIG. 3B illustrates a cross-sectional view of a section of a condenser with the lower surface energy thin coating of the present invention.

As shown in FIG. 3B, the thin coating 32B of the lower surface energy material prevents the wetting of the lubricating oil in the refrigerant and encourages the formation of droplets 34B. As the lubricating oil forms droplets 34B, rather than a film, heat transfer is encouraged.

Silane, fluorocarbons, polyetheretherketon (PEEK) and polysulfones are polymers having lower surface energies and are preferably used to form the lower surface energy solution. However, any polymer with a lower surface energy and chemical and thermal resistance can be utilized. Preferably, the solution contains a low concentration of the polymer.

Preferably, the solution contains a lower surface energy silane in very low concentrations, about 1–2% by weight, and is mixed with an inexpensive solvent. If fluorocarbons, polyetheretherketon and polysulfones are utilized, they are preferably mixed with a solvent such as a volatile organic compound (VOC). Alternatively, a vapor, rather than a solution, is run through the tubing 20.

The wettability of a surface decreases with decreasing surface energy. As the thin coatings 32A and 32B have a lower surface energy, wettability of the coatings 32A and 32B by lubricating oil decreases, increasing the formation of oil droplets 34A and 34B.

There are several advantages to using the method to reduce oil entrapment in a heat exchanger of an air conditioner of the present invention. For one, by reducing the amount of lubricating oil which forms a film on the inner surface 24A of an evaporator 18, heat transfer is improved. The lower surface energy thin coating 32A encourages the lubricating oil in the refrigerant to form droplets 34A on the inner surface 24A of the tubing 20A rather than a film 30A, reducing the clogging of the interstices 26A and allowing heat transfer to be maximized. By applying a thin coating 32B of a lower surface energy material on the inner surface 24B of the tubing 20B of a condenser 14, the lubricating oil is encouraged to form droplets 34B, which encourages heat transfer.

Accordingly, the present invention provides a method for reducing oil entrapment on the inner surface of the tubing of a heat exchanger of an air conditioner.

The foregoing description is only exemplary of the principles of the invention. Many modifications and variations of the present invention are possible in light of the above teachings. The preferred embodiments of this invention have been disclosed, however, so that one of ordinary skill in the art would recognize that certain modifications would come within the scope of this invention. It is, therefore, to be understood that within the scope of the appended claims, the invention may be practiced otherwise than as specially described. For that reason the following claims should be studied to determine the true scope and content of this invention.

What is claimed is:

1. A heat exchanger component comprising:

a plurality of flow passages; wherein said low surface energy coating is formed from a solution including a low surface energy substance and a solvent, and a low surface energy coating on a surface of said plurality of flow passages, said low surface energy coating reducing a wettability of oil on said plurality of flow passages, and wherein said low surface energy substance is a silane.

2. The heat exchanger component as recited in claim 1 wherein said solution contains said low surface energy silane in an amount of 1–2% by weight.

3. A heat exchanger component comprising:

a plurality of flow passages including a plurality of interstices; and a low surface energy coating on a surface of said plurality of flow passages, said low surface energy coating reducing a wettability of oil on said plurality of flow passages.

4. An refrigerant cycle comprising:

a compression device to compress a refrigerant to a high pressure employing a lubricating oil;

a heat rejecting heat exchanger for cooling said refrigerant including a plurality of condensing flow passages with a monomolecular layer of a law surface energy coating on a condensing surface to prevent said lubricating oil from wetting said condensing surface of said heat rejecting heat exchanger;

an expansion device for reducing said refrigerant to a low pressure; and a heat accepting heat exchanger for evaporating said refrigerant including a plurality of evaporating flow passages with a monomolecular layer of a low surface energy coating on an evaporating surface of said heat accepting heat exchanger to reduce a wettability of oil on said evaporating surface of said heat accepting heat exchanger.

5. The refrigerant cycle as recited in claim 4 wherein said low surface energy coating is formed from a solution including a low surface energy substance and a solvent.

6. The refrigerant cycle as recited in claim 5 wherein said low surface energy substance is a silane.

7. The refrigerant cycle as recited in claim 5 wherein said low surface energy substance is selected from the group consisting of fluorocarbon, polyetheretherketone, and polysulfone.

8. The refrigerant cycle as recited in claim 4 wherein said plurality of flow passages include a plurality of interstices.

9. A method for lowering the surface energy of a heat exchanger comprising the steps of coating a surface of a plurality of flow nassages of said heat exchanger with a low surface energy substance in solution and reducing a wettability of oil on said plurality of flow passages, wherein the step of coating said plurality of flow passages includes flowing said solution through said plurality of flow passages of said heat exchanger, draining said solution from said plurality of flow passages of said heat exchanger, and drying said plurality of flow passage of said heat exchanger.

10. A heat exchanger component comprising:

a plurality of flow passages; and a low surface energy coating on a surface of said plurality of flow passages, said low surface energy coating reducing a wettability or oil on said plurality of flow passages, wherein said low surface energy coating is formed from a solution including a low surface energy substance and a solvent, wherein said low surface energy substance is selected from the group consisting of polyetheretherketone and polysulfone.

11. A heat exchanger component comprising;

a plurality of flow passages; and a low surface energy coating on a surface of said plurality of flow passages, said low surface energy coating reducing a wettability of oil on said plurality of flow passages, wherein a first fluid flows through said plurality of flow passages and a second fluid flows around said plurality of flow passages, and said first fluid and said second fluid exchange heat.

12. The heat exchanger component as recited in claim 11 wherein said first fluid is refrigerant and said second fluid is a fluid medium.

13. The heat exchanger component as recited in claim 11 wherein said low surface energy coating increases heat transfer between said first fluid and said second fluid.

14. The refrigerant cycle as recited in claim 4 wherein said low surface energy substance is selected from the group consisting of polyetheretherketone and polysulfone.

15. The refrigerant cycle as recited in claim 4 wherein a first fluid flows through said plurality of flow passages and a second fluid flows round said plurality of flow passages, and said first fluid and said second fluid exchange heat.

16. The refrigerant cycle as recited in claim 15 wherein said first fluid is said refrigerant and said second fluid is a fluid medium.

17. The refrigerant cycle as recited in claim 15 wherein said low surface energy coating increases heat transfer between said first fluid and said second fluid.

18. The refrigerant cycle as recited in claim 4 wherein said oil forms droplets on said low surface energy coating.

* * * * *

UNITED STATES PATENT AND TRADEMARK OFFICE

CERTIFICATE OF CORRECTION

PATENT NO. : 6,810,999 B2
DATED : November 2, 2004
INVENTOR(S) : Otter

It is certified that error appears in the above-identified patent and that said Letters Patent is hereby corrected as shown below:

Column 4,
Line 62, “nassages” should read as -- passages --.

Column 6,
Line 11, “round” should read as -- around --.

Signed and Sealed this

Eleventh Day of January, 2005

JON W. DUDAS
*Director of the United States Patent and Trademark Office*